US010711217B2

(12) United States Patent
Monjiyama et al.

(10) Patent No.: US 10,711,217 B2
(45) Date of Patent: Jul. 14, 2020

(54) LUBRICANT BASE OIL

(71) Applicant: NOF CORPORATION, Tokyo (JP)

(72) Inventors: Shunsuke Monjiyama, Amagasaki (JP); Hideki Kawamoto, Amagasaki (JP)

(73) Assignee: NOF CORPORATION, Tokyo (JP)

( * ) Notice: Subject to any disclaimer, the term of this patent is extended or adjusted under 35 U.S.C. 154(b) by 0 days.

(21) Appl. No.: 16/309,498

(22) PCT Filed: Jun. 7, 2017

(86) PCT No.: PCT/JP2017/021118
§ 371 (c)(1),
(2) Date: Dec. 13, 2018

(87) PCT Pub. No.: WO2017/217297
PCT Pub. Date: Dec. 21, 2017

(65) Prior Publication Data
US 2019/0241823 A1 Aug. 8, 2019

(30) Foreign Application Priority Data
Jun. 14, 2016 (JP) ..... 2016-118098

(51) Int. Cl.
*C10M 105/42* (2006.01)

(52) U.S. Cl.
CPC .... *C10M 105/42* (2013.01); *C10M 2207/301* (2013.01); *C10N 2220/022* (2013.01); *C10N 2220/10* (2013.01); *C10N 2230/06* (2013.01); *C10N 2230/12* (2013.01); *C10N 2240/02* (2013.01); *C10N 2240/04* (2013.01)

(58) Field of Classification Search
CPC ..... C10N 2230/06; C10N 2240/02; C10N 2220/10; C10N 2220/022; C10N 2240/04; C10N 2230/12; C10M 2207/301
See application file for complete search history.

(56) References Cited

U.S. PATENT DOCUMENTS

| | | | | |
|---|---|---|---|---|
| 3,925,527 | A | 12/1975 | Kleimann et al. | |
| 5,698,502 | A | 12/1997 | Pafford et al. | |
| 2017/0002291 | A1* | 1/2017 | Takahashi | C10M 171/008 |

FOREIGN PATENT DOCUMENTS

| | | | |
|---|---|---|---|
| CN | 104212534 | A | 12/2014 |
| GB | 1 292 548 | A | 10/1972 |
| JP | 2000-063875 | A | 2/2000 |
| JP | 2006-265345 | A | 10/2006 |
| JP | 2012-102235 | A | 5/2012 |
| JP | 2015-147859 | A | 8/2015 |

OTHER PUBLICATIONS

International Search Report of PCT/JP2017/021118 dated Aug. 8, 2017 [PCT/ISA/210].
Communication dated Jan. 14, 2020 in European Application No. 17813195.9.

* cited by examiner

*Primary Examiner* — Vishal V Vasisth
(74) *Attorney, Agent, or Firm* — Sughrue Mion, PLLC

(57) ABSTRACT

A lubricant base oil which contains an ester. The ester constituting the lubricant base oil includes: a component (A) derived from pentaerythritol in a molar percentage $A_{mol\ \%}$ of 20 to 30 mol %; a component (B) derived from a straight-chain fatty acid having a carbon number of 14 to 22 in a molar percentage $B_{mol\ \%}$ of 55 to 79 mol %; and a component (C) derived from adipic acid in a molar percentage $C_{mol\ \%}$ of 1 to 15 mol %. A molar ratio ($C_{mol}/C_{mol}$) of the component (C) derived from adipic acid and the component (B) derived from the straight-chain fatty acid having a carbon number of 14 to 22 is 0.02 to 0.25, and the ester has a hydroxyl value of 10 to 100 mgKOH/g.

8 Claims, No Drawings

LUBRICANT BASE OIL

CROSS REFERENCE TO RELATED APPLICATIONS

This application is a National Stage of International Application No. PCT/JP2017/021118, filed Jun. 7, 2017, claiming priority based on Japanese Patent Application No. 2016-118098, filed Jun. 14, 2016.

TECHNICAL FIELD

The present invention relates to a lubricant base oil. Specifically, the present invention relates to a lubricant base oil having excellent biodegradability, excellent lubricating property (wear resistance) and excellent rust prevention property against sea water. The lubricant base oil may be suitably used for a bearing oil, hydraulic oil, gear oil or the like and more suitably used for a stern tube bearing oil used in oceans.

BACKGROUND ARTS

Recently, it is demanded new trials for environmental preservation as important mission worldwide. Such mission is also demanded in the field of a lubricating oil, and it is further demanded a lubricating oil capable of reducing environmental load more than ever. As a lubricant oil capable of reducing the environmental load, a biodegradable lubricant oil draws attention, as the lubricant oil is susceptible to decomposition in natural world to reduce its effects on ecosystem even in the case that the lubricant oil is leaked out.

Many of biodegradable lubricant oils are used as a countermeasure in the case of leakage into livers and oceans. Its use is mandatory in some regions and applications. For example, in European countries, the use of the biodegradable lubricant oil is mandated in 2-cycle engine oil in an outboard motor for use in lakes regions, hydraulic oil for a construction machinery used near a liver for taking drinking water, or the like. In the United States, the use of the biodegradable lubricant oil is mandated in a lubricant oil used in wetted parts of a ship or the like.

Various kinds of studies have been performed as to the biodegradable lubricant oil described above. For example, according to patent document 1, it is disclosed a 2-cycle engine oil composed of polybutene, a polyol ester, a paraffin-based hydrocarbon solvent and an ashless detergent. According to patent document 2, it is disclosed a hydraulic oil, composed of a complex ester of a polyvalent alcohol, a straight-chain saturated fatty acid and a straight-chain saturated polycarboxylic acid, an antioxidant and a load-bearing additive and excellent in biodegradability, oxidation stability, wear resistance and low-temperature fluidity. According to patent document 3, it is disclosed a stern tube bearing oil, composed of a water-soluble (poly)alkylene glycol, a water-soluble thickener and a water-soluble rust prevention agent and excellent in compatibility with sea water, lubricating property and biodegradability.

Further, a biodegradable lubricant oil is frequently used at locations near water such as livers and oceans as described above. The lubricant oil is thus susceptible to contamination by water, so that it is necessary to sufficiently consider for preventing metal corrosion. Particularly in the case of sea water, a metal is easily susceptible to corrosion. Further consideration is necessary for a lubricant oil, which may possible be contaminated by sea water, for use in a ship, wind turbine on ocean, ocean current generator or the like. Among these applications, very high rust prevention performance against sea water is demanded in a stern tube bearing oil in a lubricant oil for a ship.

BACKGROUND DOCUMENTS

Patent Documents (Patent document 1) Japanese patent publication No. 2000-063875A (Patent document 2) Japanese patent publication No. 2015-147859A (Patent document 3) Japanese patent publication No. 2006-265345A

SUMMARY OF THE INVENTION

An object of the present invention is to provide a lubricant base oil having excellent biodegradability, excellent lubricating property (wear resistance) and excellent rust prevention property against sea water.

The inventors intensively studied for solving the object described above. It is then found that a specific ester compound, of pentaerythritol, a specific straight-chain fatty acid and adipic acid, has good biodegradability as well and excellent lubricating property (wear resistance) and excellent rust prevention property.

That is, the present invention provides the following. It is provided a lubricant base comprising an ester. The ester comprises:

a component (A) derived from pentaerythritol in a molar percentage $A_{mol\ \%}$ of 20 to 30 mol %;

a component (B) derived from a straight-chain fatty acid having a carbon number of 14 to 22 in a molar percentage $B_{mol\ \%}$of 55 to 79 mol %; and a component (C) derived from adipic acid in a molar percentage $C_{mol\ \%}$ of 1 to 15 mol %. A molar ratio ($C_{mol}$/$B_{mol}$) of the component (C) derived from adipic acid and the component (B) derived from the straight-chain fatty acid having a carbon number of 14 to 22 is 0.02 to 0.25, and the ester has a hydroxyl value of 10 to 100 mgKOH/g.

The lubricant base oil of the present invention has excellent biodegradability as well as excellent lubricating property (wear resistance) and excellent rust prevention property against sea water. The base oil is thus suitably used for a bearing oil, hydraulic oil, gear oil or the like and more suitably used for s stern tube bearing oil used in oceans.

MODES FOR CARRYING OUT THE INVENTION

The lubricant base oil of the present invention will be described below. Further, in the specification, a numerical range defined by a symbol "-" means a numerical range including numerical values at both ends (highest value and lower value" of "-". For example, "2-5" means a value not lower than 2 and not higher than 5.

The lubricant base oil of the present invention is composed of an ester of (A) pentaerythritol, (B) a straight-chain fatty acid having a carbon number of 14 to 22, and (C) adipic acid.

Pentaerythritol is used as a raw material of the ester of the present invention. As pentaerythritol belongs to neopentyl polyol having a neopentyl bone structure, excellent oxidation stability and thermal resistance are obtained. Neopentyl glycol, trimethylolpropane and dipentaerythritol are listed the other neopentyl polyol. In the case that neopentyl glycol or trimethylolpropane is used as the raw material, however, the rust prevention property of the thus obtained ester may be insufficient. In the case that pentaerythritol is used as the raw material, the thermal stability may be insufficient. Pentaerythritol is preferred as the neopentyl polyol used in the present invention.

The straight-chain fatty acid having a carbon number of 14 to 22 used in the present invention includes a straight-chain saturated fatty acid having a carbon number of 14 to 22, a straight-chain unsaturated fatty acid having a carbon umber of 14 to 22, and the mixed fatty acids thereof. The straight-chain saturated fatty acid having a carbon number of 14 to 22 includes myristic acid, palmitic acid, stearic acid, arachidic acid and behenic acid, for example. The straight-chain unsaturated fatty acid having a carbon number of 14 to 22 includes myristoleic acid, palmitoleic acid, oleic acid, linoleic acid, linolenic acid and erucic acid, for example. The straight-chain saturated fatty acid and straight-chain unsaturated fatty acid are preferably palmitoleic acid, oleic acid, linoleic acid, linolenic acid or erucic acid, and more preferably oleic acid, linoleic or linolenic acid, and most preferably oleic acid. In the case that the number of carbon atoms is less than 14, the lubricating property (wear resistance) may be deteriorated. On the other hand, in the case that the number of carbon atoms is more than 22, the fuel consumption may be deteriorated due to energy loss caused by internal resistance of the lubricant oil itself accompanied with the high viscosity, and the thus generated ester may become a solid, which cannot be used as the lubricating oil.

In the mixed fatty acids of the straight-chain saturated fatty acid and straight chain unsaturated fatty acid each having a carbon number of 14 to 22, the content of the straight-chain unsaturated fatty acid may preferably be 60 mass percent or higher, more preferably be 65 mass percent or higher, and most preferably be 70 mass percent or higher.

As the raw material of the ester of the present invention, adipic acid is used as a diprotic acid. In the case that it is used succinic acid or the like whose carbon number is less than that of adipic acid, the effects may not be enough upon adding various kinds of additives, so that it may not be suitable as the lubricant base oil. On the other hand, in the case that it is used sebacic acid whose carbon number is larger than that of adipic acid or maleic acid containing an unsaturated bond, the oxidation stability and thermal resistance may be deteriorated. The diprotic acid used in the present invention is preferably adipic acid.

The ester constituting the lubricant base oil of the present invention includes the component (A) derived from pentaerythritol in a molar percentage $A_{mol\ \%}$ of 20 to 30 mol %; the component (B) derived from a straight-chain fatty acid having a carbon number of 14 to 22 in a molar percentage $B_{mol\ \%}$ of 55 to 79 mol %; and the component (C) derived from adipic acid in a molar percentage $C_{mol\ \%}$ of 1 to 15 mol %. A molar ratio ($C_{mol}/B_{mol}$) of the component (C) derived from adipic acid and the component (B) derived from the straight-chain fatty acid having a carbon number of 14 to 22 is 0.02 to 0.25.

$A_{mol\ \%}$, $B_{mol\ \%}$, $C_{mol\ \%}$ and ($C_{mol}/B_{mol}$) are values calculated, after the ester compound is analyzed by $^1$H NMR to obtain molar ratios of the components derived from the respective raw materials.

The measurement conditions of $^1$H NMR are shown below.

(Measurement Conditions)

Analyzing apparatus: $^1$H NMR

Solvent: Heavy chloroform $^1$H NMR chart of the ester obtained according to the measurement conditions described above is analyzed so that the molar ratios can be obtained.

Specifically, the following four kinds of peaks are used.

(Peak (I)): 3.40~3.70 ppm

Hydrogen atom on a position of unreacted hydroxyl group of (A) pentaerythritol (Peak (II)): 4.00~4.20 ppm Hydrogen atom on a position of reacted hydroxyl group of (A) pentaerythritol {a total of the peak (I) and peak (II) is eight atoms}

(Peak (III)): 0.85~0.90 ppm

Hydrogen atoms (three atoms) connected to terminal carbon atoms of the straight-chain fatty acid having a carbon number of 14 to 22

(Peak (IV)): 2.25~2.35 ppm

Hydrogen atoms (four atoms) on a position of carbonyl group of (C) adipic acid and hydrogen atoms (two atoms) on a position of carbonyl group of the straight-chain fatty acid (B) having a carbon number of 14 to 22

Integrated values of the four kinds of the peaks are calculated as follows to obtain the molar ratios $A_{mol}$, $B_{mol}$ and $C_{mol}$ of the respective components derived from the respective raw materials.

$$A_{mol}=\{\text{Integrated value of the peak}(I)+\text{integrated value of the peak }(II)\}/8$$

$$B_{mol}=\text{Integrated value of the peak}(III)/3$$

$$C_{mol}=\{\text{Integrated value of the peak}(IV)-(B_{mol}\times 2)\}/4$$

$A_{mol\ \%}$, $B_{mol\ \%}$ and $C_{mol\ \%}$ are calculated from $A_{mol}$, $B_{mol}$ and $C_{mol}$ obtained as described above as follows.

$$A_{mol\ \%}=100\times A_{mol}/(A_{mol}+B_{mol}+C_{mol})$$

$$B_{mol\ \%}=100\times B_{mol}/(A_{mol}+B_{mol}+C_{mol})$$

$$C_{mol\ \%}\%=100\times C_{mol}/(A_{mol}+B_{mol}+C_{mol})$$

Further, the molar ratios of the respective components can be calculated as follows, based on $B_{mol}$ and $C_{mol}$ described above.

$C_{mol}/B_{mol}$ is the molar ratio of the component (C) derived from adipic acid and the component (B) derived from the straight-chain fatty acid having a carbon number of 14 to 22.

$C_{mol}/A_{mol}$ is the molar ratio of the component (C) derived from adipic acid and the component (A) derived from pentaerythritol.

$B_{mol}/A_{mol}$ is the molar ratio of the component (B) derived from the straight-chain fatty acid having a carbon number of 14 to 22 and the component (A) derived from pentaerythritol.

According to the ester of the present invention, $A_{mol\ \%}$:$B_{mol\ \%}$:$C_{mol\ \%}$is 20 to 30 mol %: 55 to 79 mol %: 1 to 15 mol %. In the case that the above ranges are not satisfied, the rust prevention property may be deteriorated, the energy consumption may be deteriorated due to the energy loss resulting from the internal resistance of the lubricant oil itself accompanied with the high viscosity, the biodegradability may be deteriorated and lubricating property (wear resistance) may be deteriorated. On such viewpoints, $A_{mol\ \%}$ may preferably be 21 to 27 mol % and more preferably be 22 to 25 mol %. Further, $B_{mol\ \%}$ may preferably be 60 to 79 mol % and more preferably be 70 to 75 mol %. Further, $C_{mol\ \%}$ may preferably be 2 to 10 mol % and more preferably be 3 to 6 mol %.

Further, according to the ester of the present invention, $C_{mol}/B_{mol}$ is 0.02 to 0.25. In the case that $C_{mol}/B_{mol}$ is less than 0.02, the rust prevention property may be deteriorated. On the other hand, in the case that $C_{mol}/B_{mol}$ exceeds 0.25, the energy loss may be increased due to the internal resistance of the lubricating oil itself accompanied with the high viscosity, resulting in deterioration of energy consumption or of biodegradability. $C_{mol}/B_{mol}$ may preferably be 0.03 to 0.20 and more preferably be 0.05 to 0.10.

$C_{mol}/A_{mol}$ in the present invention may preferably be 0.05 to 0.55. $C_{mol}/A_{mol}$ is made 0.05 or higher, so that the rust prevention property can be further improved. Further, $C_{mol}/A_{mol}$ is made 0.55 or lower, so that it is possible to prevent the energy loss due to the internal resistance of the lubricating oil itself accompanied with the high viscosity and to thereby suppress the deterioration of the energy consumption and of biodegradability. On the viewpoint, $C_{mol}/A_{mol}$ may preferably be 0.10 to 0.40 and more preferably be 0.15 to 0.30.

$B_{mol}/A_{mol}$ in the present invention may preferably be 2.0 to 4.0. $B_{mol}/A_{mol}$ may be made 2.0 or higher, so that it is possible to suppress the energy loss due to the internal resistance of the lubricating oil itself accompanied with the high viscosity and to suppress the reduction of the energy consumption due to the internal resistance and the reduction of the biodegradability. $B_{mol}/A_{mol}$ may be made 4.0 or lower, so that the rust prevention property can be further improved. On the viewpoint, $B_{mol}/A_{mol}$ may preferably be 2.3 to 3.8 and more preferably be 2.5 to 3.5.

The ester of the present invention has a hydroxyl value of 10 to 100 mgKOH/g. In the case that the hydroxyl value of the ester is below 10 mgKOH/g, the rust prevention property may be deteriorated. On the other hand, in the case that the hydroxyl value of the ester exceeds 100 mgKOH/g, the lubricating property (wear resistance) and oxidation stability may be deteriorated. On the viewpoint, the hydroxyl value of the ester of the present invention may preferably be 15 to 75 mgKOH/g and more preferably be 20 to 60 mgKOH/g.

The kinematic viscosity at 40° C. of the inventive ester may preferably be 60 to 300. The kinematic viscosity at 40° C. of the ester may be made 60 or higher, so that the lubricating property (wear resistance) can be further improved. Further, the kinematic viscosity at 40° C. of the ester may be made 300 or lower, so that it is possible to reduce the energy loss due to the internal resistance of the lubricating oil itself accompanied with the high viscosity and to suppress the reduction of the energy consumption. On the viewpoint, the kinematic viscosity at 40° C. of the ester may preferably be 70 to 200 and more preferably be 75 to 150.

The acid value of the inventive ester may preferably be 10.0 mgKOH/g or lower. The acid value of the ester is made 10.0 mgKOH/g or lower, so that the reduction of the lubricating property (wear resistance) and oxidation stability can be suppressed. On the viewpoint, the acid value of the ester may preferably be 5.0 mgKOH/g or lower and more preferably be 3.0 mgKOH/g or lower.

The lubricant base oil of the present invention is excellent in biodegradability. It is preferred that the biodegradability is 60 percent or higher, in the case that a biodegradability test is performed according to either of OECD 301A, B, C, D, E and F.

The lubricating oil of the present invention may optionally contain conventionally known additives for a lubricating oil, for improving the performances, in addition to the lubricant base oil of the ester. As the additive, an antioxidant, wear prevention agent, metal deactivator, antifoamer and the like may be appropriately mixed with the ester if desired in amounts that the object of the present invention is not suppressed, to prepare the lubricating composition. A single kind of the additive may be used alone or two or more kinds of the additives may be used in combination.

The oxidation preventing agent includes a phenol-based oxidation prevention agent, an amine-based oxidation prevention agent, a sulfur-based oxidation prevention agent or the like.

The phenol-based oxidation prevention agent includes 2, 6-di-t-butyl-p-cresol, 4, 4'-methylene bis-(2,6-di-t-butylphenol), 4, 4'-thiobis(2-methyl-6-t-butylphenol), 4, 4'-bis(2, 6-di-t-butylphenol) or the like, for example.

The amine-based oxidation prevention agent includes phenyl-α-naphthylamine, phenyl-β-naphthylamine, alkylphenyl-α-naphthylamine, alkylphenyl-β-naphthylamine, bis (alkylphenyl)amine, phenothiazine, monooctyldiphenylamine and the like, for example. Further, a part of the amine-based oxidation prevention agents may be categorized into a quinoline-based oxidation prevention agent. The quinoline-based oxidation prevention agent includes 2, 2, 4-trimethyl-1, 2-dihydroquinoline or its polymerized product, 6-methoxy-2, 2, 4-trimethyl-1, 2-dihydroquinoline or its polymerized product, and 6-ethoxy-2, 2, 4-trimethyl-1, 2-dihydroquinoline or its polymerized product, for example.

The sulfur-based oxidation prevention agent includes alkyl disulfide, benzodiazole and the like, for example.

Among the oxidation prevention agents described above, the amine-based oxidation prevention agent is particularly preferred. It is more preferred bis(alkylphenyl) amine and a quinoline based oxidation prevention agent, and it is most preferred 4, 4'-bis (α, α-dimethylbenzyl) diphenylamine and 2, 2, 4-trimethyl 1,2-dihydroquinoline or its polymerized product.

A single kind of the oxidation prevention agent may be used alone or two or more kinds of the oxidation prevention agents may be mixed and used in combination. In the case that two or more kinds of the oxidation prevention agents are mixed and used, the amine-based oxidation prevention agent and phenol-based oxidation prevention agent may be preferably used in combination.

The wear prevention agent includes olefin sulfide, sulfide fats and oils, a sulfide, a phosphoric acid ester, phosphorous acid ester, thiophosphoric acid ester, amine salt of phosphate, zinc dialkyldithiophosphate, dialkyl polysulfide and the like, for example. A single kind of the wear prevention agent may be used alone or two or more kinds of the wear prevention agents may be used in combination.

The metal inactivator includes benzotriazole or its derivative, alkenyl succinic acid ester and the like, for example. A single kind of the metal inactivator may be used alone or two or more kinds of the metal deactivators may be used in combination.

The antifoamer includes a silicone-based compound or the like.

The blending, mixing and adding methods of the respective additives are not particularly limited, and various methods may be applied. The order of the blending, mixing and adding are not particularly limited, and various kinds of methods may be applied. For example, it may be used the method of directly adding various kinds of additives to the ester constituting the base oil and then heated, or of preparing solution of a high concentration of the additive and mixing the solution with the base oil.

EXAMPLES

Inventive Example 1

(Synthesis of Ester of Pentaerythritol/Adipic Acid/Straight-Chain Fatty Acid Having a Carbon Number of 14 to 22 of 1/0.21/3.12 (Molar Ratio)

Into a four-necked flask of 3 liters equipped with a thermometer, a tube for introducing nitrogen, an agitator and a cooling tube, it was charged 400 g (2.94 mol) of pentaerythritol, 93 g (0.63 mol) of adipic acid and 2519 g (9.05 mol) of straight-chain fatty acids (2.0 mass percent of myristic acid:1.4 mass percent of myristoleic acid:0.2 mass percent of pentadecenoic acid:4.2 mass percent of palmitic acid:7.0 mass percent of palmitoleic acid:1.6 mass percent of heptadecenoic acid:1.2 mass percent of stearic acid:73.8 mass percent of oleic acid:6.7 mass percent of linoleic acid:1.8 mass percent of linolenic acid:0.1 mass percent of arachidic acid). The reaction was performed under nitrogen atmosphere at 240° C. at ambient pressure, while water generated by the reaction was evaporated. The reaction product was cooled, and 0.5 mass percent of activated clay was added to the reaction product to perform the adsorption. The reaction product was subjected to filtration to remove the adsorption agent to obtain the desired ester.

Inventive Examples 2 to 7

Various kinds of esters of the inventive examples 2 to 7 shown in table 1 were obtained, according to the same procedure as the Inventive Example 1.

Comparative Examples 1 to 4

Various kinds of esters of the Comparative Examples 1 to 4 were obtained, according to the same procedure as the Inventive Example 1.

Comparative Example 5

It was obtained the ester of the Comparative Example 5 shown in table 2, according to the same experimental procedure as that in the Inventive Example 1, except that trimethylolpropane was used as a raw material instead of pentaerythritol.

Comparative Example 6

The ester of the Comparative Example 6 shown in table 2 was obtained, according to the same procedure as the Inventive Example 1. However, it was used mixture of 55 mass percent of caprylic acid (straight-chain saturated fatty acid having a carbon number of 8) and 45 mass percent of caproic acid (straight-chain saturated fatty acid having a carbon number of 10), instead of the straight-chain fatty acid used in the inventive example 1.

The following tests were performed for each of the esters synthesized as described above. The measurement results of the respective esters were shown in tables 1 and 2.

(Composition of Esters)

$^1$H NMR measurement was performed as described above, for the thus obtained esters. $A_{mol\ \%}$, $B_{mol\ \%}$, $C_{mol\ \%}$, ($C_{mol}/B_{mol}$), ($A_{mol}/C_{mol}$) and ($B_{mol}/A_{mol}$) were thus calculated.

(Viscosity and Viscosity Index)

They were measured according to Japanese Industrial Standards JIS 2283.

(Flash Point)

Flash point was measured using a Cleveland Open-Cup tester according to Japanese Industrial standards JIS K 2565. As the flush point obtained in the test is higher, the fire-retardant property is better.

(Acid Value and Hydroxyl Value)

They were measured according to Japanese industrial Standards JIS K0070.

(Biodegradability Test)

Biodegradability test was performed according to OECD 301C. In the case that the biodegradability measured by the test is 60 percent or higher, it is qualified standards as a biodegradable lubricant oil according to ECO MARK OFFICE of Public Interest Incorporated foundation "Japan Environment Association". According to this test, it is marked as "◎" in the case that the biodegradability is 70 percent or higher, it is marked as "○" in the case that the biodegradability is 60 percent or higher and below 70 percent, and it is marked as "X" in the case that the biodegradability is below 60 percent.

(Shell Four-Ball Wear Test)

Using a high-speed Shell four-ball testing machine, wear scar diameter (μm) was measured according to ASTM D4172. As the wear scar diameter (μm) is smaller, the wear resistance is better.

(Rust Prevention Performance Test)

According to the test, it was performed the test according to, but under severer conditions than those defined in, the rust prevention performance test of a lubricant oil (in artificial sea water for 24 hours) based on Japanese Industrial Standards JIS K 2510. According to the test, a steel bar (S20C) polished and washed was immersed in mixed solution (60° C.) in which 10 weight percent of sea water was added to the lubricating composition. It was then observed the state of generation of rust after 1 week, 2 weeks and 1 month. Besides, the mixed solution was continuously agitated while the bar was immersed. According to the test, "○" was marked in the case that the rust was not generated, and "X" was marked in the case that the rust was generated.

TABLE 1

| | Inventive Examples | | | | | | |
|---|---|---|---|---|---|---|---|
| | 1 | 2 | 3 | 4 | 5 | 6 | 7 |
| Molar ratio $A_{mol\ \%}$ of component (A) (mol %) | 23.1 | 23.1 | 25.6 | 22.5 | 27.5 | 21.6 | 28.9 |
| Molar ratio $B_{mol\ \%}$ of component (B) (mol %) | 72.1 | 75.0 | 61.5 | 71.9 | 68.7 | 76.7 | 57.8 |
| Molar ratio $C_{mol\ \%}$ of component (C) (mol %) | 4.8 | 1.9 | 12.8 | 5.6 | 3.8 | 1.7 | 13.3 |
| $C_{mol}/B_{mol}$ | 0.067 | 0.025 | 0.208 | 0.078 | 0.056 | 0.022 | 0.230 |
| $C_{mol}/A_{mol}$ | 0.21 | 0.08 | 0.50 | 0.25 | 0.14 | 0.08 | 0.46 |
| $B_{mol}/A_{mol}$ | 3.12 | 3.24 | 2.40 | 3.20 | 2.50 | 3.56 | 2.00 |

TABLE 1-continued

| | | Inventive Examples | | | | | | |
|---|---|---|---|---|---|---|---|---|
| | | 1 | 2 | 3 | 4 | 5 | 6 | 7 |
| Hydroxyl value (mg KOH/g) | | 26 | 34 | 41 | 16 | 83 | 15 | 86 |
| Kinematic viscosity at 40° C. ($mm^2/s$) | | 96.2 | 77.5 | 133 | 96.7 | 101 | 81.6 | 191 |
| Kinematic viscosity at 100° C. ($mm^2/s$) | | 15.7 | 13.1 | 19.3 | 16.4 | 14.9 | 13.2 | 23.4 |
| Viscosity index | | 175 | 171 | 165 | 183 | 154 | 164 | 150 |
| Flash point (° C., COC method) | | 320 | 302 | 328 | 322 | 316 | 306 | 336 |
| Acid value (mg KOH/g) | | 2.3 | 2.0 | 2.0 | 2.5 | 1.5 | 2.6 | 1.3 |
| Biodegradability test | | ◎ | ◎ | ○ | ◎ | ◎ | ◎ | ○ |
| Wear resistance (wear scar diameter (μm)) | | 350 | 420 | 382 | 393 | 465 | 421 | 431 |
| Rust prevention performance test | 1 week | ○ | ○ | ○ | ○ | ○ | ○ | ○ |
| (Artificial sea water) | 2 weeks | ○ | ○ | ○ | ○ | ○ | X | ○ |
| | 1 month | ○ | X | ○ | X | ○ | X | ○ |

TABLE 2

| | | Comparative Examples | | | | | |
|---|---|---|---|---|---|---|---|
| | | 1 | 2 | 3 | 4 | 5 | 6 |
| Molar ratio of component derived from trimethylolpropane | | — | — | — | — | 28.8 | — |
| Molar ratio $A_{mol\ \%}$ of component (A) (mol %) | | 22.6 | 29.4 | 31.3 | 16.4 | — | 28.2 |
| Molar ratio $B_{mol\ \%}$ of component (B) (mol %) | | 76.9 | 52.9 | 62.5 | 82.0 | 66.3 | — |
| Molar ratio $C_{mol\ \%}$ of component (C) (mol %) | | 0.5 | 17.6 | 6.3 | 1.6 | 4.9 | 12.7 |
| Molar ratio of component derived from straight-chain saturated fatty acid having a carbon number of 8 or 10 | | — | — | — | — | — | 59.2 |
| $C_{mol}/B_{mol}$ | | 0.006 | 0.333 | 0.100 | 0.02 | 0.074 | — |
| $C_{mol}/A_{mol}$ | | 0.02 | 0.60 | 0.20 | 0.10 | — | 0.22 |
| $B_{mol}/A_{mol}$ | | 3.40 | 1.80 | 2.00 | 5.00 | — | — |
| Hydroxyl value (mg KOH/g) | | 31 | 84 | 132 | 3 | 27 | 80 |
| Kinematic viscosity at 40° C. ($mm^2/s$) | | 69.2 | 256 | 120 | 81.2 | 81.4 | 188 |
| Kinematic viscosity at 100° C. ($mm^2/s$) | | 12.3 | 30.3 | 16.1 | 13.8 | 13.5 | 23.2 |
| Viscosity index | | 178 | 158 | 144 | 177 | 169 | 159 |
| Flash point (° C., COC method) | | 300 | 345 | 326 | 314 | 304 | 276 |
| Acid value (mg KOH/g) | | 2.1 | 2.2 | 0.5 | 2.6 | 2.2 | 1.5 |
| Comparative Examples | | 1 | 2 | 3 | 4 | 5 | 6 |
| Biodegradability test | | ◎ | X | ◎ | ◎ | ◎ | ○ |
| Wear resistance (wear scar diameter (μm)) | | 430 | 425 | 564 | 405 | 408 | 865 |
| Rust prevention | 1 week | X | ○ | ○ | X | X | X |
| performance test | 2 weeks | X | ○ | ○ | X | X | X |
| (Artificial sea water) | 1 month | X | ○ | ○ | X | X | X |

According to the results shown in table 1, the lubricant base oils composed of the esters of the inventive examples 1 to 7 satisfying the requirements of the present invention are excellent in the rust prevention property, lubricating property (wear resistance) and biodegradability.

According to the results shown in table 2, as the ester of the comparative example 1 has low $C_{mol\ \%}$ and ($C_{mol}/B_{mol}$), the rust prevention property is deteriorated.

As the ester of the comparative example 2 has high $C_{mol\ \%}$ and ($C_{mol}/B_{mol}$), the biodegradability is deteriorated.

As the ester of the comparative example 3 has high $A_{mol\ \%}$ and a high hydroxyl value, the lubricating property (wear resistance) is low.

As the ester of the comparative example 4 has low $A_{mol\ \%}$, high $B_{mol\ \%}$ and a low hydroxyl value, the rust prevention property is deteriorated.

According to the ester of the comparative example 5, pentaerythritol is not used and instead trimethylolpropane is used as the raw material, so that the rust-prevention property is deteriorated.

As it is used the straight-chain fatty acid having a carbon number of less than 14 as the raw material in the ester of the comparative example 6, the lubricating property (wear resistance) and rust prevention property are deteriorated.

INDUSTRIAL APPLICABILITY

The lubricant base oil of the present invention has excellent biodegradability as well as excellent rust prevention property and excellent lubricating property. The base oil is thus suitably used for, a hydraulic oil, gear oil, bearing oil or the like and more suitable used for s stern tube bearing oil used in oceans or the like.

The invention claimed is:

1. A lubricant base oil consisting of an ester, said ester comprising:

a component (A) derived from pentaerythritol in a molar percentage $A_{mol\ \%}$ of 20 to 30 mol %;

a component (B) derived from a straight-chain fatty acid having a carbon number of 14 to 22 in a molar percentage $B_{mol\ \%}$ of 55 to 79 mol %; and a component (C) derived from adipic acid in a molar percentage $C_{mol\ \%}$ of 1 to 15 mol %, wherein a molar ratio ($C_{mol}/B_{mol}$) of said component (C) derived from adipic acid and said component (B) derived from said straight-chain fatty acid having a carbon number of 14 to 22 is 0.02 to 0.25, and wherein said ester has a hydroxyl value of 10 to 100 mgKOH/g.

2. The lubricant base oil as claimed in claim 1, wherein said molar percentage $C_{mol\ \%}$ is 2 to 10 mol %.

3. The lubricant base oil as claimed in claim 1, wherein said straight-chain saturated fatty acid comprises myristic acid, palmitic acid, stearic acid, arachidic acid, behenic acid, myristoleic acid, palmitoleic acid, oleic acid, linoleic acid, linolenic acid and erucic acid.

4. The lubricant base oil as claimed in claim 1, preventing rust against sea water.

5. A bearing oil consisting of the lubricant base oil as claimed in claim 1.

6. A hydraulic oil consisting of the lubricant base oil as claimed in claim 1.

7. A gear oil consisting of the lubricant base oil as claimed in claim 1.

8. A stern tube bearing oil consisting of the lubricant base oil as claimed in claim 4.

* * * * *